US005279438A

United States Patent [19]

Cesano

[11] Patent Number: 5,279,438

[45] Date of Patent: Jan. 18, 1994

[54] PLASTICS BOX WITH CORNER UPRIGHTS

[76] Inventor: Franco Cesano, Via Brusiti 13/B, I-10060 San Secondo di Pinerolo (Torino), Italy

[21] Appl. No.: 69,938

[22] Filed: Jun. 1, 1993

[30] Foreign Application Priority Data

Jun. 9, 1992 [EP] European Pat. Off. ..... 92830299.1

[51] Int. Cl.[5] ..... B65D 6/26

[52] U.S. Cl. ..... 220/7; 220/684

[58] Field of Search ..... 220/7, 6, 1.5, 693, 220/684, 683; 217/15, 13, 47, 45; 229/198.3, 198.1

[56] References Cited

U.S. PATENT DOCUMENTS

| | | | |
|---|---|---|---|
| 778,809 | 12/1904 | Stokes | 229/198.1 |
| 3,223,309 | 12/1965 | Chiorri | 229/198.1 |
| 3,401,814 | 9/1968 | Chiswell et al. | 220/4.33 |
| 4,002,261 | 1/1977 | Litchfield | 220/4.33 |
| 4,115,655 | 9/1978 | Prentice | 220/683 |
| 4,167,353 | 9/1979 | Gebhardt | 220/684 |
| 4,210,274 | 7/1980 | Leonard | 229/198.1 |
| 4,591,065 | 5/1986 | Foy | 220/7 |
| 4,673,087 | 6/1987 | Webb | 220/4.33 |

FOREIGN PATENT DOCUMENTS

| | | |
|---|---|---|
| 1611004 | 9/1970 | Fed. Rep. of Germany . |
| 1.304.633 | 8/1962 | France . |
| 1169727 | 11/1969 | United Kingdom . |
| 1247340 | 9/1971 | United Kingdom . |
| 2108573 | 5/1983 | United Kingdom . |

*Primary Examiner*—Allan N. Shoap
*Assistant Examiner*—S. Castellano
*Attorney, Agent, or Firm*—Edward D. Manzo

[57] ABSTRACT

The box includes a sheet of moulded plastics material with a central portion constituting the base of the box and four foldable flaps which are hinged to the central portion form the side walls of the box. The foldable flaps are interconnected by corner uprights each of which includes a central rib and two rows of segments which constitute the opposed walls of a pair of channels for housing the side edges of the flaps. The segments in each row are separated by spaces the heights of which, along the longitudinal axis of the rib, are equal to or greater than the heights of the segments in the opposite row, along the same axis. The segments in each row face the spaces between the segments in the opposite row.

7 Claims, 3 Drawing Sheets

PLASTICS BOX WITH CORNER UPRIGHTS

DESCRIPTION

The present invention relates to a plastics box of the type including:

a sheet of moulded plastics material with a central portion constituting the base of the box and fourfoldable flaps which are hinged to the central portion and form the side walls of the box, and four corner uprights of plastics material, each having two channels in which the respective side edges of two adjacent flaps are fitted.

In boxes of the type specified above which have already been proposed, the uprights have the function of providing the side walls of the boxes with rigidity and of supporting the weight of a stack of superposed boxes. French patent No. 1,344,783 describes a box made of paper-based material, the side flaps of which are interconnected by corner elements constituted by metal sections.

Many attempts have also been made to produce plastics uprights which achieve a mechanically stable connection with the ends of the side flaps of the box and which are strong enough to support the weight of the superposed boxes. A plastics box with side walls which are articulated to the base wall and are fixed together by corner elements is known from the French document No. 2,217,223. The edges of the side walls have T-shaped cross-sections and are intended to be fitted in channels of undercut cross-section in the corner element. In order to produce an upright of the type described in the French document No. 2,217,223, it is necessary to use dies which have slides and are much more complex, delicate and expensive than simple two-part dies with which, however, it is impossible to produce undercut cross-sections.

U.S. Pat. No. 4,210,274 recognises that the injection moulding of the corner uprights is a very expensive process because of the complexity of the dies and consequently proposes the extrusion of uprights for collapsible boxes. However, the extrusion technique does not permit uprights to be formed with support bases suitable for the lateral support of superposed boxes. Extruded uprights therefore require further, pin-shaped elements which are produced by injection moulding and enable a certain degree of interpenetration of the superposed uprights.

If one considers that the market requires an annual production of boxes of the order of tens of millions of items/year and that each box needs four uprights, it will be understood how important it is to find a solution which enables the uprights to be produced as economically as possible.

The object of the present invention is to provide an upright which can be produced by injection-moulding technology, with the use of simple, two-piece dies without movable members.

According to the present invention, this object is achieved by virtue of the fact that each upright includes:

a central rib with a longitudinal axis perpendicular to the base of the box, and first and second rows of segments which are integral with the rib and have respective bearing surfaces constituting the opposed walls of the channels for housing the side edges of the flaps, the segments in each row being separated by spaces the heights of which, along the longitudinal axis of the rib, are equal to or greater than the heights of the segments in the opposite row, along the same axis, the bearing surfaces of the segments in each row facing the spaces between the segments in the opposite row.

The solution according to the invention provides a stable mechanical connection between the side walls of the box and the uprights without the need to form channels of undercut cross-section in the uprights. It is consequently possible to use simple two-part dies which can produce a very large number of pieces, for example, 25–50 for each moulding cycle. This solution also enables recycled or filled thermoplastics materials to be used. By solving the problem of the cost of the uprights, the present invention makes plastics boxes competitive with the wooden or cardboard boxes which are currently used widely for packaging fruit and vegetables.

Further characteristics and advantages of the present invention will become clear in the course of the detailed description which follows with reference to the appended drawings, provided purely by way of non-limiting example, in which.

Figure 1:
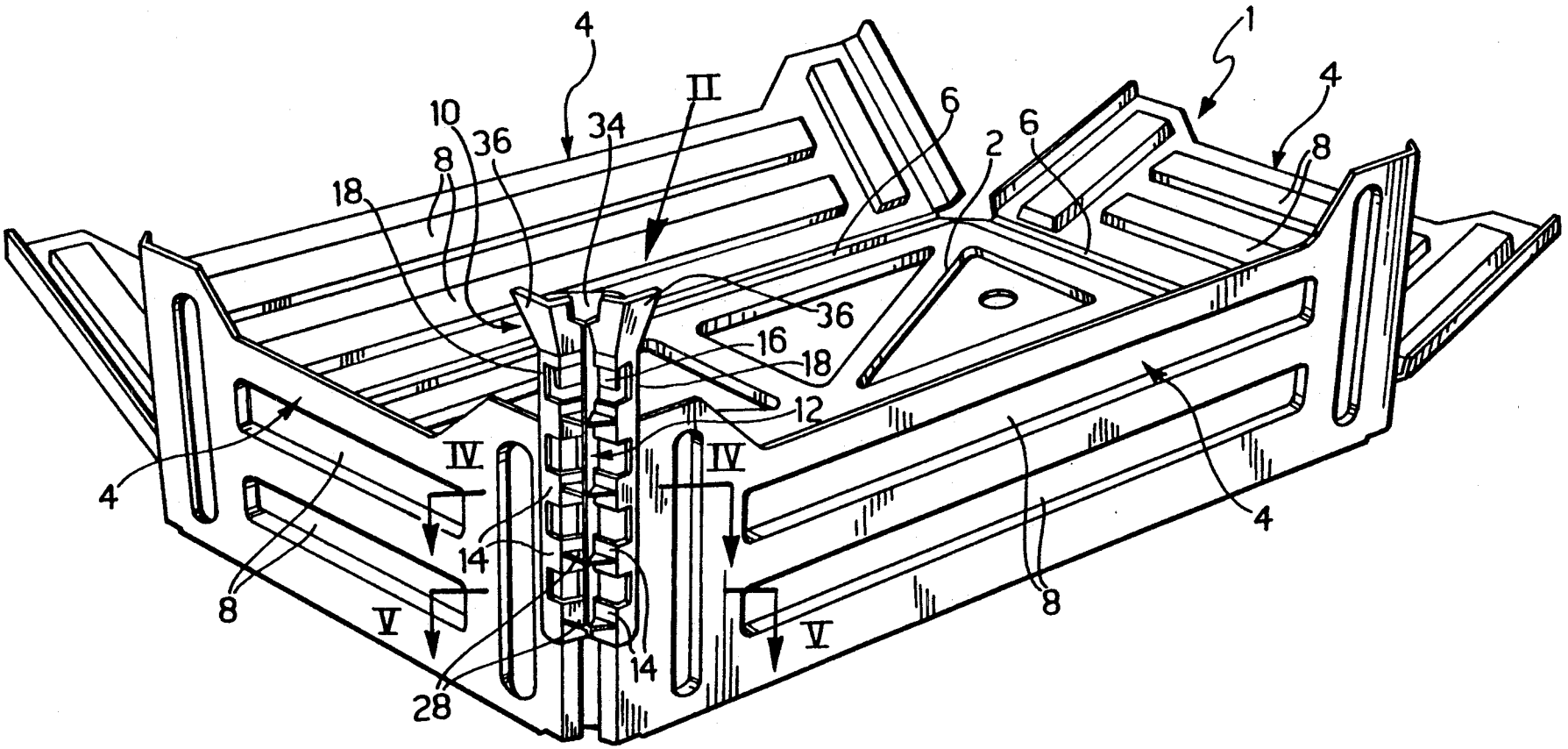
FIG. 1 is a perspective view of a box according to the present invention.

With reference to FIG. 1, a sheet of plastics material, indicated 1, is constituted by a rectangular, central portion 2, to each side of which a foldable flap 4 is hinged. The central portion 2 constitutes the base of a box and the flaps 4 form the side walls of the box. The flaps 4 are hinged to the central portion 2 by recesses 6 of depths less than the thickness of the rest of the sheet 1. Both the central portion 2 and the flaps 4 have stiffening ribs 8.

The sheet 2 is produced by the compression-moulding of a material constituted by a thermoplastic matrix and by fillers formed from waste products which are difficult to recycle, for example, thermosetting plastics materials.

The flaps 4 are movable from positions in which they extend parallel to the central portion 2 to positions in which they are perpendicular to the portion 2. The flaps 4 are kept in their second positions by four corner uprights 10 of plastics material, only one of which is visible in FIG. 1.

As can be seen in greater detail in FIGS. 2 to 5, the upright 10 is constituted by a one-piece body of injection-moulded plastics material and has a central rib 12, the longitudinal axis A of which is perpendicular to the base 2 of the box. First and second rows of segments, indicated 14 and 16 respectively, extend from the central rib 12. Each segment is constituted by two portions, indicated 14*a*, 14*b* and 16*a*, 16*b*, which are arranged symmetrically with respect to the central rib 12. The segments 14 in the first row are connected to a pair of lateral ribs 18 parallel to the central rib 12. The segments 14 in the first row are separated by spaces 20, the heights H of which along the axis A are equal to or greater than the heights h of the segments 16 in the second row. The segments 16 in the second row face the spaces 20 between the segments 14 in the first row. This arrangement of the segments enables the upright 10 to be produced by a two-part die without slides or the like.

Figure 4:
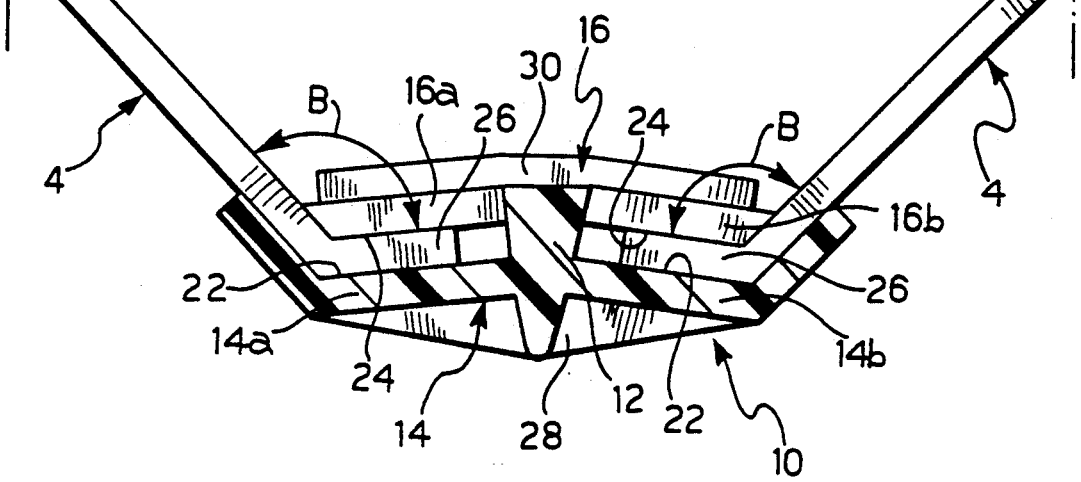
Figure 5:
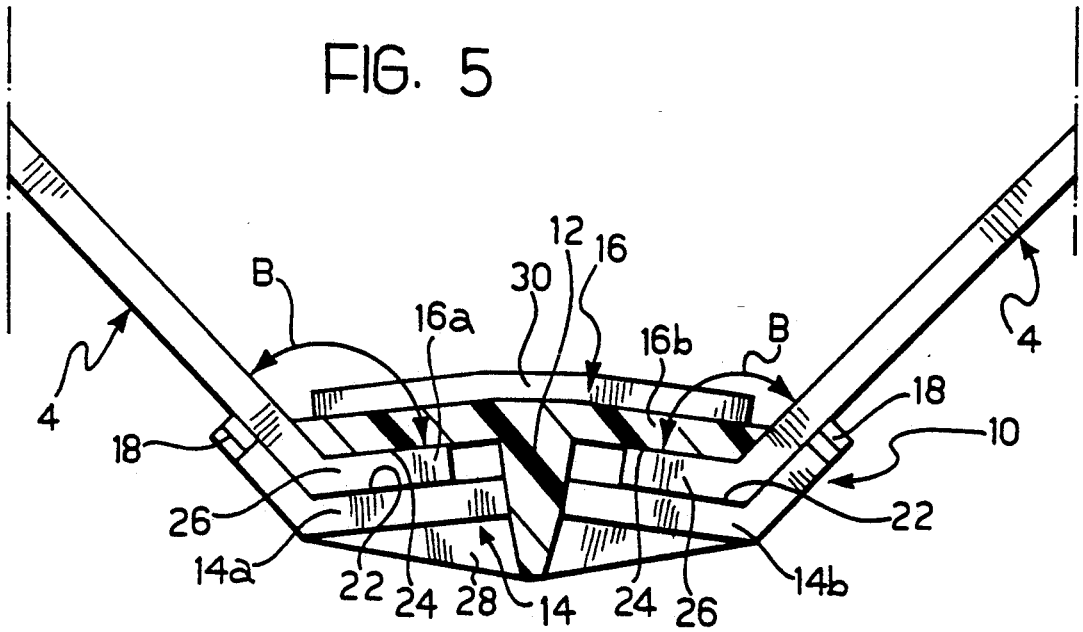

With reference to FIGS. 4 and 5, the segments 14, 16 have respective parallel bearing surfaces 22, 24 between which two channels are defined for housing respective side edges 26 of two adjacent flaps 4. The side edges 26 of the flaps 4 are inclined to the flaps 4 at an angle B greater than 90°. The bearing surfaces 22 of the segments 14 in the first row are inclined in a manner corresponding to the inclination of the edges 26 of the flaps 4.

Figure 3:
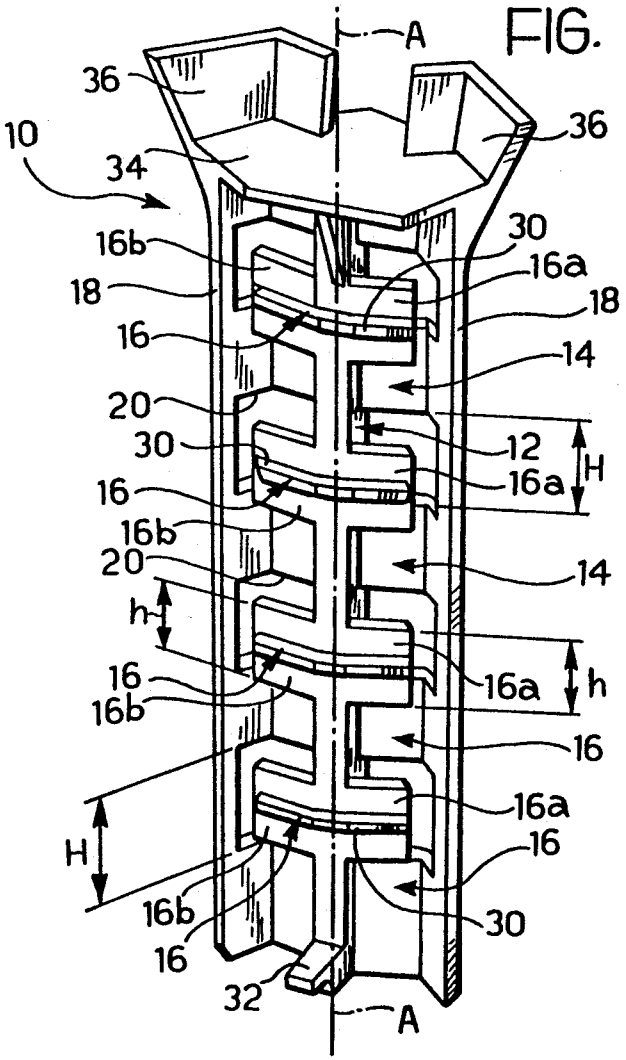
FIG. 3 is a perspective view of the upright, taken on the arrow III of FIG. 2, and FIGS. 4 and 5 are sections taken on the lines IV—IV and V—V of FIG. 1.
Figure 2:
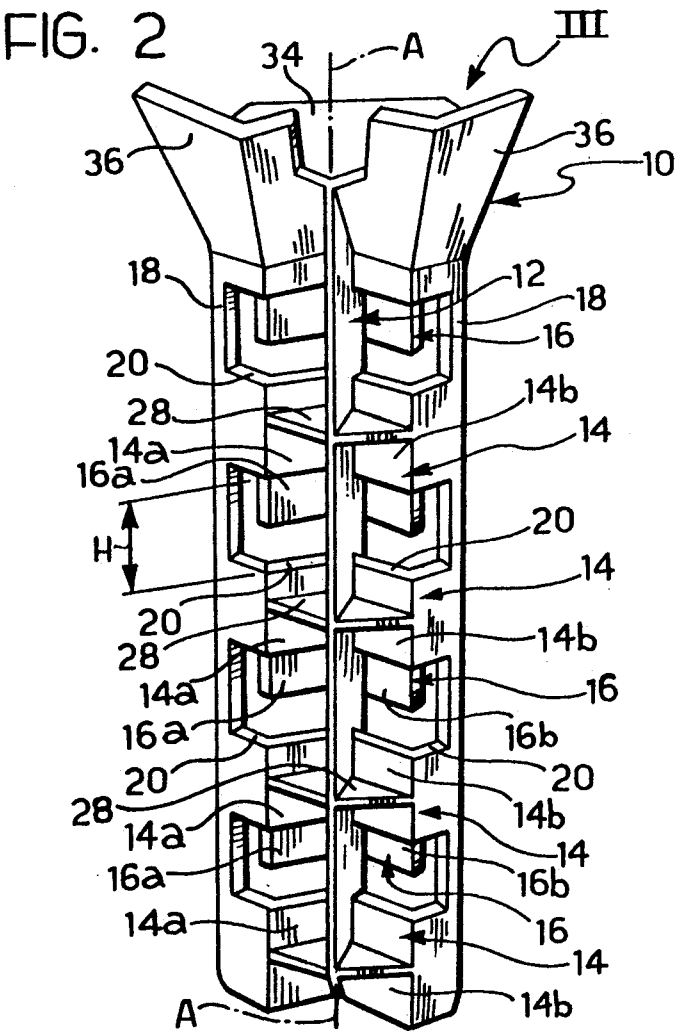
FIG. 2 is a perspective view of the upright indicated by the arrow II in FIG. 1, on an enlarged scale.

A stiffening rib 28, 30 projects from a rear surface of each segment 14, 16, transverse the central rib 12. As can be seen in FIG. 3, the central rib 12 has a tab 32 which is intended to abut the base 2 of the box. Still with reference to FIG. 3, the central rib 12 and the lateral ribs 18 are formed integrally with a flat support base 34 which is perpendicular to the axis A of the rib 12. The base 34 forms a support for a corresponding upright of a superposed box. Two diverging walls 36 project from the base 34 for laterally restraining and guiding the corner of a superposed box.

The same type of upright 10 can be used both for boxes with tall side walls, of the type shown in FIG. 1, and for boxes with low side walls of about half the height of the upright 10.

I claim:

1. A plastics box including:

a sheet of molded plastics material with a central portion constituting a base of the box and four foldable flaps having side edges which are hinged to the central portion and form side walls of the box, and four corner uprights of plastics material, each having two channels in which respective side edges of two adjacent flaps of said flaps are fitted, each upright including:

a central rib attached to each channel with a longitudinal axis perpendicular to the base of the box, and said channels having first and second rows of segments which are integral with the rib and have respective bearing surfaces constituting opposed walls of said channels housing said side edges of the flaps, the segments in each row being separated by spaces the heights of which, along the longitudinal axis of the rib, are equal to or greater than the heights of the segments in the opposite row, along the same axis, the segments in each row facing the spaces between the segments in the opposite row.

2. A box according to claim wherein each segment in each row is formed by two portions which are symmetrical with respect to the central rib.

3. A box according to claim 1, wherein the segments in the first row define first bearing surfaces which engage outwardly facing surfaces of the flaps and are formed integrally with a pair of lateral ribs which are parallel to the central rib and on opposite sides thereof.

4. A box according to claim 3, wherein the central rib and the lateral ribs are connected integrally to a flat support base for supporting a corresponding upright of a superposed box.

5. A box according to claim 4, wherein walls project from said support base for guiding and laterally restraining a corner of said superposed box.

6. A box according to claim 3, wherein the side edges of said flaps are inclined to the flaps, and wherein the segments in the first row have further first bearing surfaces which are inclined in a manner corresponding to an inclination of the side edges.

7. A box according to claim 1, wherein the segments in each row have stiffening ribs disposed transverse to the central rib and projecting from surfaces opposed to said respective bearing surfaces of the segments.

* * * * *